US009706846B2

(12) United States Patent
Rogers

(10) Patent No.: US 9,706,846 B2
(45) Date of Patent: Jul. 18, 2017

(54) CHAIR BACK ASSEMBLY

(71) Applicant: Exemplis Corporation, Cypress, CA (US)

(72) Inventor: Brett Joseph Rogers, Tustin, CA (US)

(73) Assignee: Exemplis Corporation, Cypress, CA (US)

( * ) Notice: Subject to any disclaimer, the term of this patent is extended or adjusted under 35 U.S.C. 154(b) by 149 days.

(21) Appl. No.: 14/734,610

(22) Filed: Jun. 9, 2015

(65) Prior Publication Data

US 2016/0360888 A1 Dec. 15, 2016

(51) Int. Cl.
*A47C 7/40* (2006.01)

(52) U.S. Cl.
CPC ..... *A47C 7/40* (2013.01)

(58) Field of Classification Search
None
See application file for complete search history.

(56) References Cited

U.S. PATENT DOCUMENTS

| | | | | | |
|---|---|---|---|---|---|
| 4,365,840 | A * | 12/1982 | Kehl | A47C 4/02 | 297/232 |
| 4,492,409 | A * | 1/1985 | Laird | A47C 31/02 | 297/440.21 |
| 5,110,186 | A * | 5/1992 | Clark | A47C 3/04 | 297/440.2 |
| 5,326,155 | A | 7/1994 | Wild | | |
| 5,401,075 | A | 3/1995 | Venuto et al. | | |
| 5,478,134 | A | 12/1995 | Bernard et al. | | |
| 5,733,001 | A | 3/1998 | Roberts | | |
| 6,033,027 | A | 3/2000 | Conner et al. | | |
| 6,042,187 | A | 3/2000 | Conner et al. | | |
| 6,062,649 | A | 5/2000 | Nagel et al. | | |
| 6,099,076 | A | 8/2000 | Nagel et al. | | |
| 6,116,688 | A | 9/2000 | Wilkerson et al. | | |
| 6,168,239 | B1 | 1/2001 | Conner et al. | | |
| 6,220,661 | B1 | 4/2001 | Peterson | | |
| 6,305,750 | B1 | 10/2001 | Buono et al. | | |
| 6,378,942 | B1 | 4/2002 | Chu | | |
| 6,425,637 | B1 | 7/2002 | Peterson | | |
| 6,508,509 | B2 | 1/2003 | Peterson | | |
| 6,820,936 | B2 | 11/2004 | Wilkerson et al. | | |
| 6,969,121 | B2 | 11/2005 | Drajan | | |
| 7,216,936 | B2 | 5/2007 | Peterson | | |
| 7,604,298 | B2 | 10/2009 | Peterson et al. | | |
| 8,172,332 | B2 * | 5/2012 | Masunaga | A47C 7/282 | 297/452.13 |
| 8,678,504 | B1 * | 3/2014 | Bakker | A47C 3/04 | 297/440.14 |
| 2005/0151409 | A1 * | 7/2005 | Infanti | A47C 4/02 | 297/440.2 |

* cited by examiner

*Primary Examiner* — David E Allred
(74) *Attorney, Agent, or Firm* — Erik Birkeneder; Nixon Peabody LLP

(57) ABSTRACT

A new chair back assembly is disclosed with attachment mechanisms that allow the chair back components to be relatively easily assembled while maintaining a slim profile and obscuring certain of the attachment mechanisms from view. In some embodiments, the chair back assembly includes a ring that attaches fabric or upholstery to the base of chair back. The ring attaches to the base of the chair back through a system of flanges and pockets that restrict movement while maintaining ease of assembly.

9 Claims, 7 Drawing Sheets

CHAIR BACK ASSEMBLY

FIELD

The present invention is directed to a chair back assembly including systems and methods for assembling chair back components.

BACKGROUND

The following description includes information that may be useful in understanding the present invention. It is not an admission that any of the information provided herein is prior art or relevant to the presently claimed invention, or that any publication specifically or implicitly referenced is prior art.

Office chairs and other modern chairs often include a large number of components. For example, the chair backs include various components that may be assembled together including for mounting fabric or upholstery that hides mechanical components inside of the chair back. The various mechanisms that are typically utilized to attach the components of the chair back include standard mechanisms such as screws, bolts, nuts and others.

SUMMARY

However, the assembly of the chair back components utilizing standard attachment mechanisms can be time consuming and meticulous. This can lead to high manufacturing costs, quality problems, and difficulties repairing the chair back assembly. Particularly, it is difficult to design components that are easy to assemble, while still retaining a chair back with a thin profile, without the visual appearance of fasteners. In some instances, the upholstery or fabric of a chair back may be attached to the chair back utilizing a ring and foam combination that frames the upholstery. The mechanism utilized for attachment of such a ring to the chair back is critical to maintain a thin profile and pleasing appearance, and also to maintaining ease of manufacturing and assembly.

Existing designs for attaching the ring to the base of a chair back are cumbersome, and both time consuming and complicated to assemble. Additionally, most designs do not maintain a slim profile and/or allow the fasteners to show from the outside, detracting from the visual appearance.

Accordingly, the inventor has developed new chair back components and attachment mechanisms that allow the chair back components to be relatively easily assembled while maintaining a slim profile and obscuring certain of the attachment mechanisms from view. In some embodiments, the chair back assembly includes a ring that attaches fabric or upholstery to the base of chair back. The ring attaches to the base of the chair back through a system of flanges and pockets that, once locked, restrict movement in all directions except one.

In some embodiments, the flanges protrude in an orientation that allows the flanges to be inserted into the pockets and maintain a secure fit, while maintaining a slim profile. In some embodiments, a screw, screw tree, J-clip or other fastener will attach the back base to the ring in order to prevent the ring and flanges from sliding back out of the pockets. In some embodiments, the flanges and pockets will be positioned around a perimeter of the ring and back base.

Various methods are disclosed for assembling a chair back that utilize an improved attachment mechanism that, in some embodiments, includes a system of flanges and pockets. In various embodiments, a method is disclosed for assembling a chair back that includes providing a back base that includes a series of pockets around the perimeter; and providing a ring that includes a series of flanges that are positioned and oriented to fit within pockets. For instance, the spacing and orientation of the flanges along a ring must be complementary to the spacing and orientation of the pockets along the back base so that the flanges may fit into the pockets simultaneously when the ring is assembled with the back base to form the chair back. In some embodiments, the ring may be fixed to the back base using a screw or other attachment device along the ring to attach the ring to the base. For instance, a screw tree, U-lock, J-clip or other device may retain the ring and flanges from sliding back out of the pockets.

In some embodiments, once the ring is installed, a foam lining may be attached (e.g., glued) to the outer edge of the ring. In those embodiments, a fabric liner may be stretched across the outside of the foam liner or otherwise installed on the foam lining. In other embodiments, a mesh may be installed in between the outer edges of the ring. In some embodiments, the ring may be removed from the seat back by removing any fasteners and pulling the ring in a direction that releases the flanges from the pockets. This may advantageously be utilized for repairing various mechanisms, for instance a lumbar support mechanism, that may be contained behind the fabric and within the seat back.

The pockets and flange system will advantageously allow the ring to be mechanically retained by the base and in some embodiments permit motion only along one axis and in one direction once in place. In some embodiments, the set of screws or other fasteners therefore may be minimal in order to prevent the flanges of the chair back ring from sliding back out of the pockets. Additionally, the flanges if angled in a direction that is parallel to the plane of the chair back, will have a minimal profile or add minimal thickness to the chair back while providing maximum retention force. Additionally, the flanges may be positioned on the inside of the ring, and therefore the flange and pocket system may be hidden from view in order to preserve the modern, sleek appearance of a chair.

In some embodiments, the pockets may be connected along the ring and the flanges may be connected along the seat back. In some embodiments, the flanges may be angled so that they protrude towards a center of the chair back, or in other directions that are complementary to the openings of the pockets.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

Figure 1:
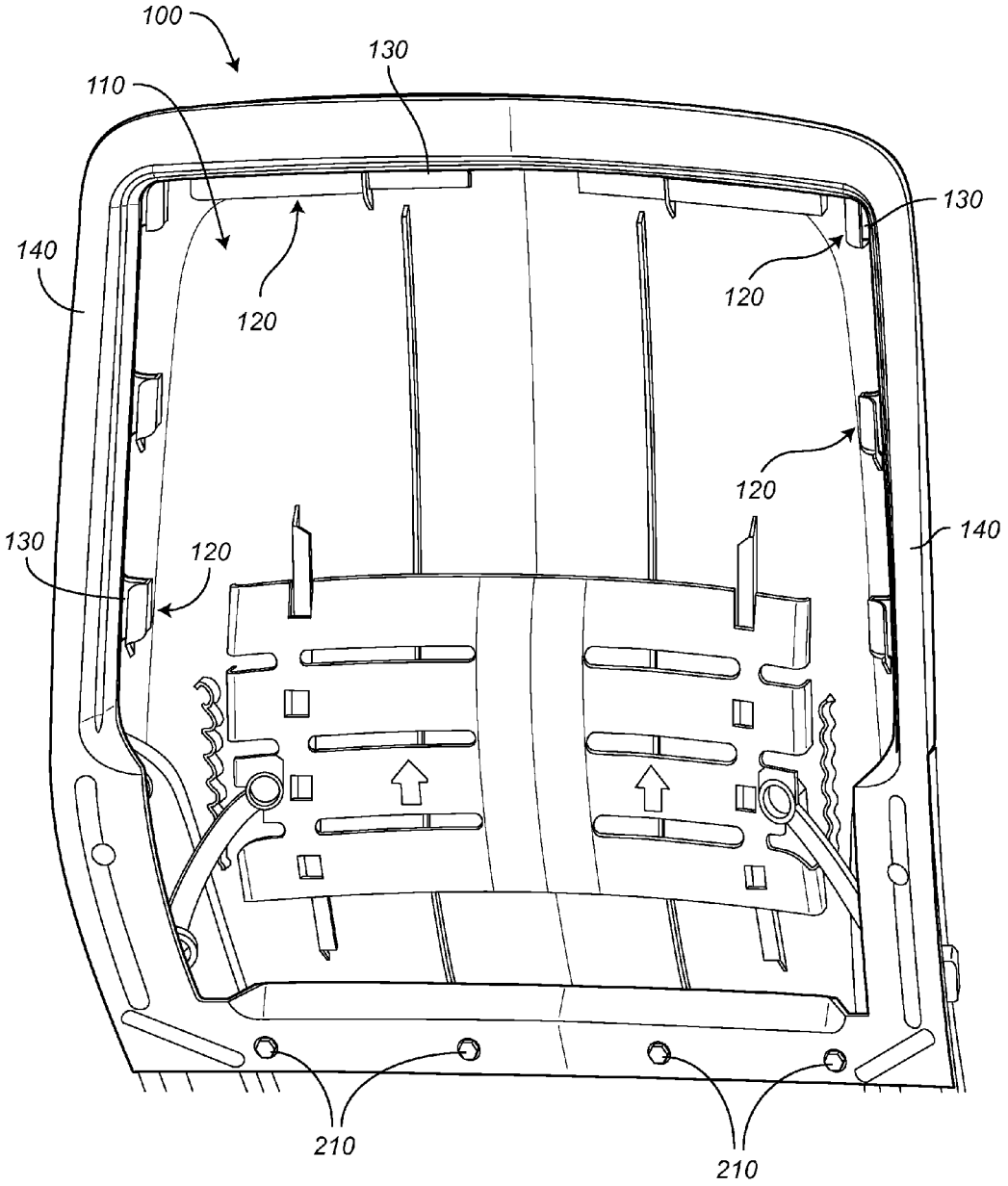
FIG. 1 depicts, in accordance with various embodiments of the present invention, a perspective view of a chair back assembly including a ring with flanges inserted into pockets that are connected to a chair base.

In the drawings, the same reference numbers and any acronyms identify elements or acts with the same or similar structure or functionality for ease of understanding and convenience. To easily identify the discussion of any particular element or act, the most significant digit or digits in a reference number refer to the Figure number in which that element is first introduced.

DETAILED DESCRIPTION

Unless defined otherwise, technical and scientific terms used herein have the same meaning as commonly understood by one of ordinary skill in the art to which this invention belongs. One skilled in the art will recognize many methods and materials similar or equivalent to those described herein, which could be used in the practice of the present invention. Indeed, the present invention is in no way limited to the methods and materials specifically described.

In some embodiments, properties such as dimensions, shapes, relative positions, and so forth, used to describe and claim certain embodiments of the invention are to be understood as being modified by the term "about."

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other obvious features not described in detail herein. Additionally, some well-known structures or functions may not be shown or described in detail below, so as to avoid unnecessarily obscuring the relevant description.

The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly while operations may be depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Overview

FIG. 1 illustrates an example of a chair back 100 assembly according to the present disclosure. The chair back 100 assembly includes a back base 110 that may serve as the foundation for the chair back 110. Pockets 120 are included on the back base 110, and in this embodiment, are positioned around the perimeter of back base 110. The chair back 100 assembly may also include a ring 140 with flanges 130 that fit inside of pockets 120 in order to mount ring 140 onto the back base 110. In some embodiments, this system provides a simple and low profile mechanism and assembly process in order to connect a fabric backing to the back of back base 110 in order to create a covered back of the chair.

In some embodiments, the ring 140 may include foam or other mounting material that may be glued or otherwise affixed to the ring 140. Then, a fabric or other upholstery may be fastened to the foam in order to enclose the entire or majority of the chair back 110. Accordingly, in some embodiments, the ring 140 provides a structural frame for fabric to cover the mechanical components (e.g., a lumbar support adjustment mechanism as shown) on the non-user side of the chair back 100.

Accordingly, the ease, simplicity, and durability of the attachment mechanism between the ring 140 and the back base 110 will determine the efficiency, and robustness of the assembly process. Accordingly, in some embodiments, a pocket 120 and flange 130 attachment mechanism is disclosed that connects the ring 140 to the back base 110. In some embodiments, the pockets 120 will line the back base 110 while complementary flanges 130 will line the ring 140. In these embodiments, the flanges 130 will be shaped so that they can slide into at least a portion of the pockets 120 so that the pockets 120 will mechanically retain the flanges 130 and connected ring 140.

In some embodiments, the ring 140 will include flanges 130 that are pointing inward toward the center of the chair back 100, and the back base 110 will include open pockets 120 that have an opening that is open to the top and to the side (e.g., the side opening may open towards the center of the chair back, or inwardly). That way, the flanges 130 and associated ring 140 may be assembled onto the back base 110 by sliding the ring 140 downwardly and along the back base 110 until the flanges 130 slide into and inside of the openings in the pockets 120. Once the ring 140 has slid all the way down so that the flanges 130 hit the bottom or sidewall of the pockets 120, the pockets 120 will restrain the ring 140 from sliding further down. Accordingly, the ring 140 will then be held into place by gravity and the pockets, and would only be able to be removed by pulling the ring 140 and flanges 120 out of the pockets 120 by lifting the ring 140 upwards. Accordingly, in these embodiments, the ring 140 may include a fastening mechanism 210 like a screw, bolt, plastic screw tree or other mechanism that will prevent the ring 140 from sliding upward and the flanges 120 from sliding out of the pockets 120.

Pockets

Figure 2:
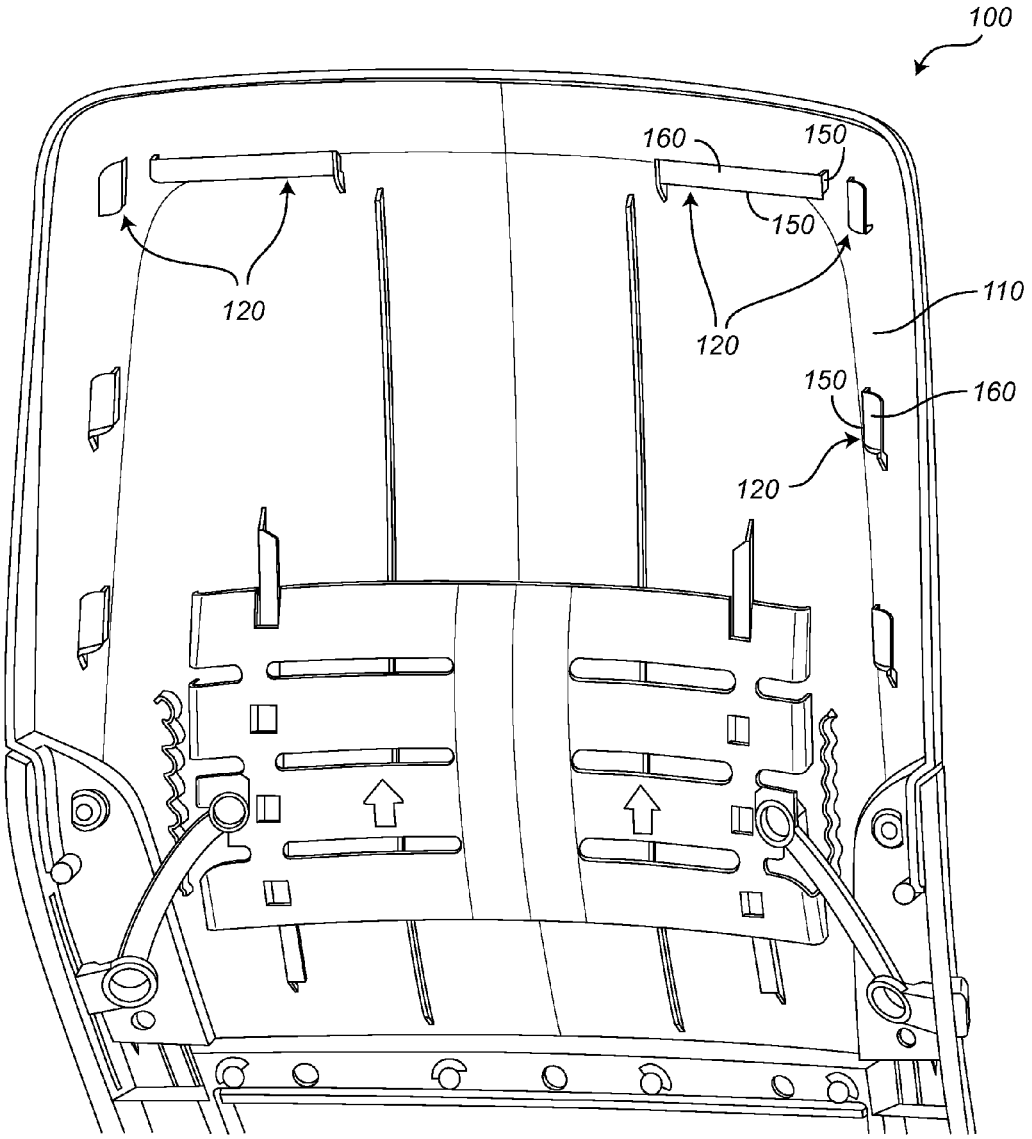
FIG. 2 depicts, in accordance with various embodiments of the present invention, a perspective view of a base of a chair back that includes pockets around a perimeter of the chair back.

FIG. 2 illustrates an embodiment of the base 110 that includes pockets 120 spaced around the perimeter of the base 110. The pockets 120 provide a mechanical anchor for attaching the ring 140. As illustrated, the pockets 120 comprise, in some embodiments, one or two side walls 150 and a co-planar wall 160. Accordingly, each individual pockets 120 may restrict movement in three directions to prevent the flanges 130 and ring 140 from: (1) moving away out from the back base 110, (2) moving downward with respect to the back base 110 and (3) moving either left or right with respect to the back base 110.

Figure 3:
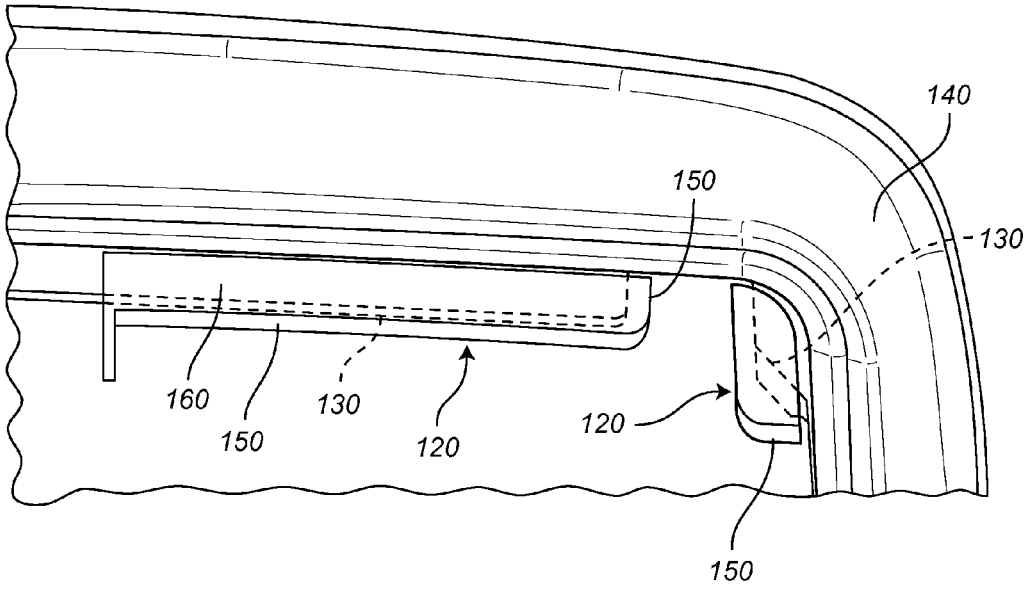
FIG. 3 depicts, in accordance with various embodiments of the present invention, a cut out view of a corner of a chair back that includes pockets that are illustrated as transparent and flanges in broken lines that are contained inside of the pockets.

FIG. 3 illustrates a cutout view showing a top pocket 120 and top flange 130 and a side pocket 120 and side flange 130. The flanges 130 are illustrated in broken lines as inserted into the pocket 120 space. The side pocket 120 has an opening that is accessible from at least two directions: (1) from the top and (2) from the side that is oriented away from a vertical centerline of the chair back 100. Additionally, the top pocket 120 illustrated has an opening that is accessible from at least two directions: (1) from the top and (2) from the side that is oriented toward from a vertical centerline of the chair back 100 (i.e. on the left side of the top pocket 120 as illustrated).

FIG. 3 also illustrates a side flange 130 that is inserted into a side pocket 120 by protruding into the top and side opening of the side pocket 120. The dual access openings of the pockets 120 allow for much greater ease of assembly as the flanges 130 are easier to slide into a pocket 120 that has an opening that allows access from two directions, rather than just an opening that allows access from one direction (i.e., a slot).

In embodiments where pockets 120 are configured to allow movement in only two planes (e.g. where each pocket 120 has an opening that allows access from the top and side) the pockets 120 may be placed in complementary and opposite positions to allow their combination to restrict movement in all directions except for one. For example, a set of side pockets 120 may be positioned on opposite sides of the back base 110 so that access to the openings of the pockets from the top and from the sides that are oriented away from a vertical center line bisecting the chair back. Accordingly, the combination of both side pockets 120 will restrict movement in the horizontal plane of the ring 140 with respect to the back base 110 in both directions.

Accordingly, the combination of both side pockets 120 (i.e., the right and left pockets 120) would restrict movement of a ring 140 with flanges 130 both to the right and to the left, and also restrict movement of the ring 140 downwardly with respect to the back base 110. This is despite the fact that each individual pocket 120 may only restrict the ring 140 from moving down and from moving only to the left or to the right. Therefore, the combination of both side pockets 120 on either side of the chair back 110 and with openings with mirror image orientations, would restrict the ring 140 from moving with respect to the back base 110 (as shown in FIG. 1) except for in an upward direction. This combination maximizes ease of construction and assembly, because the openings with top and side access make the precision with which the flanges 130 need to be lined up with the pockets 120 minimal. This is in contrast to example, an opening that is only accessible from the top such as a slot, which requires more precision to insert a flange inside.

Furthermore, placement of the pockets 120 in some embodiments, along the perimeter of the back base 110 (or the pockets 120 could be attached to the ring 140 and flanges attached to the back base 110) will make the connection between the ring 140 and the back base 110 tight at the edges, for enhancing the visual appearance by preventing openings along the perimeter. In some embodiments, top pockets 120 may also be placed along the top perimeter of the back base 110 (or ring 140), in order to provide additional stability and retention of the ring 140 to the back base 110.

In some embodiments, however, the pockets 120 may have only one opening (e.g. to the top), and have sidewalls that restrict movement in all directions except for into and out of the slot of the pocket 120, by sliding in the flanges 130 from the top or other suitable direction. In these embodiments, it is contemplated that fewer pockets 120 may be required and that overall stability may be increased with the tradeoff that assembly may require more precision. However, in this embodiment, the ease of assembly by sliding the ring 140 into the pockets 120 or slots would still be retained.

In some embodiments, pockets 120 may have flat sidewalls 150 to accept flat flanges 130 and maintain a tighter fit. In some embodiments, the sidewalls 150 may be of uniform height to form a square or rectangular pocket 120 as illustrated in FIG. 3. In these embodiments, the flanges 130 may also have a rectangular shape.

In some embodiments, the pockets 120 may have sidewalls 150 that become narrower at the back of the pockets 120, to further improve the ease of assembly. In some embodiments, the sidewalls 150 may meet at corners or may be rounded to more easily guide the flanges 130 to the proper orientation inside of pockets 120.

Flanges

FIG. 3 illustrates a top flange 130 and a side flange 130 inserted into pockets 120. The flanges may be any complementary tab of material that fits into pockets 120. In some embodiments, flanges 130 may be rectangular tabs that have flat and uniform height sidewalls. In some embodiments, flanges 130 may narrow towards the tip for easier insertion and assembly. In some embodiments, flanges 130 may have rounded corners, flat corners, or other suitable configurations that are complementary to the chose pockets 120.

In embodiments where pockets 120 have openings with access from two sides (e.g. the top and side), the flanges 130 may be connected to ring 140 or base back 110 through the entire length of the flange 130. Accordingly, these side pockets that have openings with side access will allow the side flanges 130 to maintain a connection to the ring 140 along the entire vertical length of the flange 130. This is advantageous, because it provides flanges 120 that have a connection to the ring 140 with high structural integrity and provide an ease of manufacturing In some embodiments, flanges 130 will be included in ring 140 and in other embodiments flanges 130 will be included on back base 110. In some embodiments, where pockets 120 only have one opening in the slot configuration, flanges 130 will have a connection (for example near the top of the flange 130) and then be separated from the wall of the ring 140 (or back base 110) so that it may fit into the slot of the pocket 140. This configuration may still provide some ease of construction, but allowing the pieces to be assembled by sliding the flanges 130 into the slots of the pockets 120, and may also add to the rigidity of the connection. However, manufacturing flanges 130 that are separated from the ring 140 may be more complex and expensive, and lead to flanges 130 that are structurally weaker than if connected along the length of the wall of the ring 140 or back base 110.

Figure 5A:
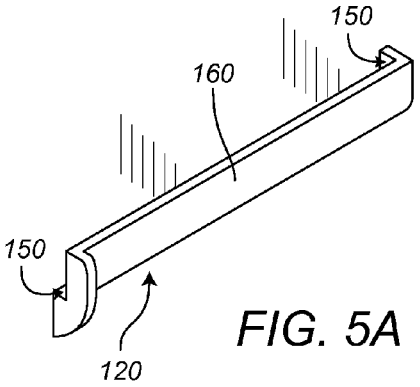
FIGS. 5A depicts, in accordance with various embodiments of the present invention, a perspective view of a top pocket.
Figure 5B:
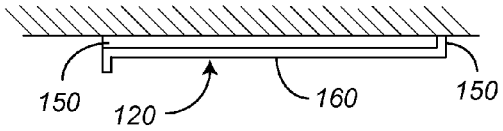
FIGS. 5B depicts, in accordance with various embodiments of the present invention, a top down view of a top pocket.
Figure 5C:
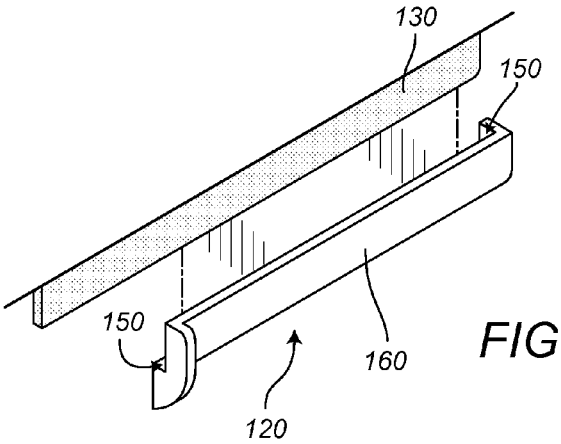
FIGS. 5C depicts, in accordance with various embodiments of the present invention, a perspective view of a top pocket with a flange being inserted into the pocket.

FIGS. 5A-5C illustrate a close up view of an embodiment of a top pocket 120 from different angles, including a perspective view (5A), a top down view (5B) and a perspective view with a flange 130 being inserted into the pocket 120 (5C). As illustrated, the pockets 120 include two side walls 150 that are perpendicular or relatively perpendicular to the plane of the chair base 110 and a co-planar wall 160 that is co-planar with the plane of the chair base 110.

As shown in FIG. 5B, the one of the side walls 150 (on the right) and the co-planar wall 160 form a slot for the flange 130 to slide into. Additionally, the other side wall 150 provides a back stop for the end of the flange 130 to be stopped and held into place. FIG. 5C illustrates a flange 130 being inserted into the top pocket 120.

Figure 6A:
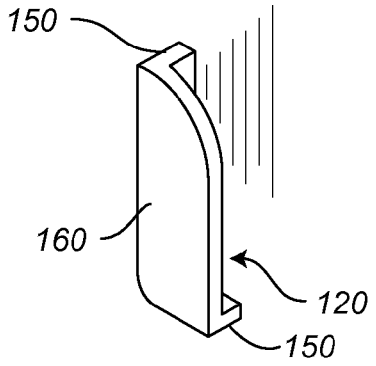
FIGS. 6A depicts, in accordance with various embodiments of the present invention, a perspective view of a side pocket.
Figure 6B:
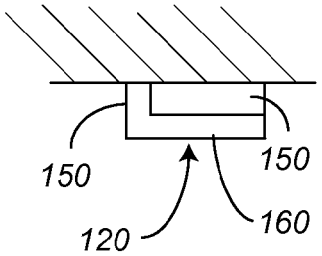
FIGS. 6B depicts, in accordance with various embodiments of the present invention, a top down view of a side pocket.
Figure 6C:
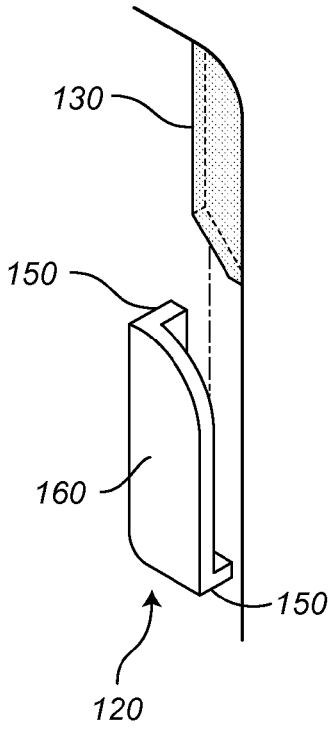
FIGS. 6C depicts, in accordance with various embodiments of the present invention, a perspective view of a side pocket with a flange being inserted into the pocket.

FIGS. 6A-6C illustrate a close up view of an embodiment of a side pocket 120 from different angles, including a perspective view (5A), a top down view (5B) and a perspective view with a flange 130 being inserted into the pocket 120 (5C). As illustrated, the pockets 120 may include two side walls 150 that are perpendicular or relatively perpendicular to the plane of the chair base 110 and a co-planar wall 160 that is co-planar with the plane of the chair base 110.

As shown in FIG. 6B, the one of the side walls 150 (on the left) and the co-planar wall 160 form a slot for the flange 130 to slide into. Additionally, the other side wall 150 (on the bottom) provides a back stop for the end of the flange 130 to be stopped and held into place. FIG. 6C illustrates a flange 130 being inserted into the top pocket 120.

Manufacturing Methods

Figure 4:
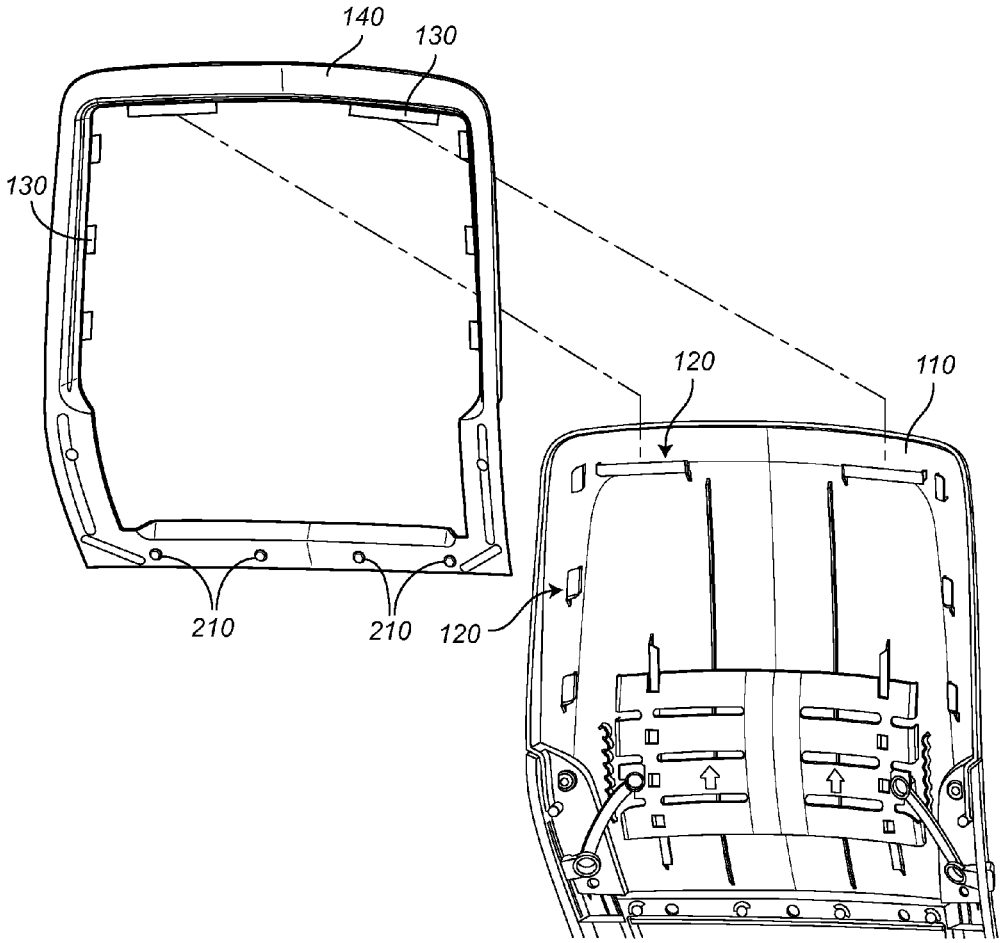
FIG. 4 depicts, in accordance with various embodiments of the present invention, an exploded view of a chair back assembly including a ring and back base.

FIG. 4 illustrates an exploded view of the separate components of the chair back 100, including the back base 110 and ring 140. The presently disclosed chair back 100 system may be manufactured by fabricating a chair base 110 with pockets 120 as described herein and fabricating a ring 140 with flanges 130 as described herein. The components of the chair back systems may be fabricated from various plastics, wood, metal or other materials. The components may be fabricated using injection molding for plastic, welding, stamping or other known fabrication methods. The pockets 120 must be manufactured so that they are complementary to the flanges 130 and so that the flanges 130 fit inside of the pockets 120. In some embodiments, the fit between the flanges 130 and the pockets 120 may be a tight enough fit to allow friction to retain the flanges 130 inside the pockets 120.

A ring 140, in some embodiments, may be separately manufactured, from, for example, an injection molding process that includes flanges 130. In some embodiments, where flanges 130 are attached to the ring 140 along their entire length, the forms required for injection molding will be less complicated and expensive. In these embodiments, the back base 110 may be injection molded to include pockets 120 that are complementary to flanges 130. In other embodiments, the ring 140 may be injection molded to include pockets 120 and the back base 110 may be injection molded, or other manufacturing processes may be utilized to form flanges 130.

Assembly Methods

Various methods are disclosed for assembling the separate components of the chair back 100 illustrated in FIG. 4. In some embodiments, after fabrication of the various components as described herein, the components will be assembled at various stages. For example, in some embodiments, a back base 110 will be provided that includes pockets 120 as illustrated in, for example, FIG. 4 and FIG. 2. In this example, the pockets 120 may be constructed to include sidewalls that define an opening with access from the top and one side. In this embodiment, the pockets 120 may have one or more side walls 150, and a co-planar wall 160.

In some embodiments, a ring 140 with flanges 130 may be provided. The flanges may be manufactured as tabs that protrude from the ring 140. The flanges may have a connection to the ring that runs the length the flange 130. The ring 140 may then be connected to the back base 110 by inserting the flanges 130 into the pockets 120. This may be performed by sliding the ring 140 downwardly and relatively parallel to the back base 110 so that flanges 120 are inserted into the top and side openings of the pockets 120.

Once the ring 140 and flanges 120 are in place and connected to the pockets 120 and back base 110, certain fasteners may be utilized to prevent the ring 140 and flanges 130 from sliding back out of the pockets 120. In some embodiments, these may be plastic tap-in fasteners 210 such as plastic tree type fasteners. In other embodiments, a screw, bolt and nut or other fasteners 210 may be utilized to fix the ring 140 into position and prevent the ring 140 and flanges 120 from sliding back out of the pockets 120.

In some embodiments, the opening in pockets 120 may be oriented in other directions so that the opening can be accessed from a downward and side direction. In this embodiment, for example, the flanges 130 may be slid into the pockets 120 from the bottom opening. In other embodiments, the flanges 130 may be on the back base 110 and the pockets 120 may be on the ring 140. In this embodiment, the pockets 120 may require an additional side wall or may be recessed in the ring 140.

In addition, to this embodiment, other potential methods for manufacturing the orientation and configuration of the pockets are contemplated by the disclosure herein. For instance, the axis along which the flanges 130 travel into the pocket recess may be at an angle to a plane that is co-planar with the plane of the back base 110. This may provide further ease of manufacturing, so that the flanges may more easily be positioned and slid into the pockets 120. However in that embodiment, the pockets 120 may require an extra bottom side wall, or at least a portion of the back base 110 for example may need to be angled and raised.

Figure 7:
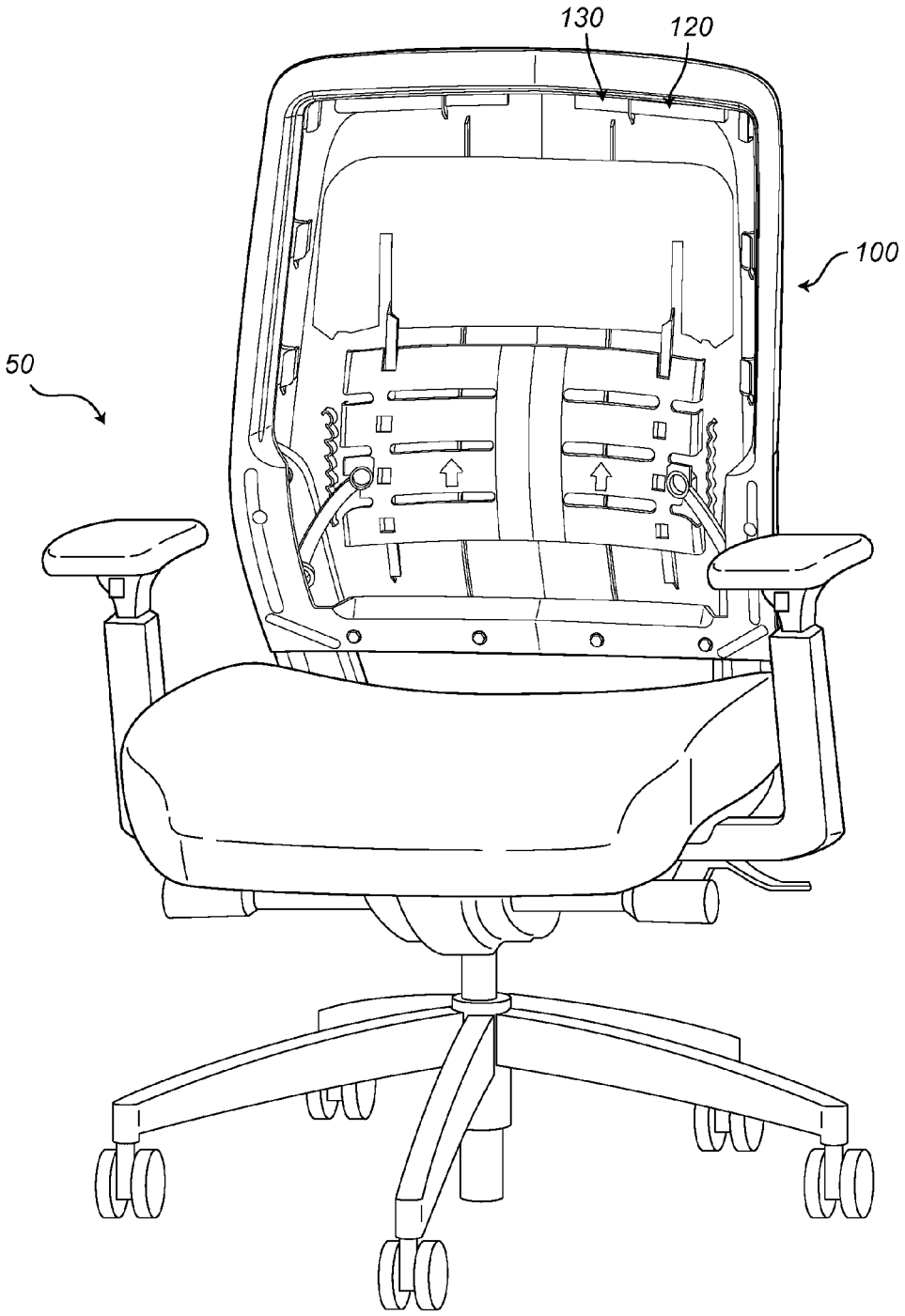
FIG. 7 depicts, in accordance with various embodiments of the present invention, a perspective view of a chair assembly.

FIG. 7 illustrates an embodiment of a fully assembled chair 50 according to the present disclosure. In some embodiments, the fully assembled chair 50 may include chair back 100, pockets 120 and flanges 130. Pockets 120 and flanges 130 may be spaced in complementary positions along chair back 100 to allow the pockets 120 and flanges 130 to fit together when chair back 100 is assembled.

CONCLUSIONS

The various methods and techniques described above provide a number of ways to carry out the invention. Of course, it is to be understood that not necessarily all objectives or advantages described can be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as taught or suggested herein. A variety of alternatives are mentioned herein. It is to be understood that some embodiments specifically include one, another, or several features, while others specifically exclude one, another, or several features, while still others mitigate a particular feature by inclusion of one, another, or several advantageous features.

Furthermore, the skilled artisan will recognize the applicability of various features from different embodiments. Similarly, the various elements, features and steps discussed above, as well as other known equivalents for each such element, feature or step, can be employed in various combinations by one of ordinary skill in this art to perform methods in accordance with the principles described herein. Among the various elements, features, and steps some will be specifically included and others specifically excluded in diverse embodiments.

Although the application has been disclosed in the context of certain embodiments and examples, it will be understood by those skilled in the art that the embodiments of the application extend beyond the specifically disclosed embodiments to other alternative embodiments and/or uses and modifications and equivalents thereof In some embodiments, the terms "a" and "an" and "the" and similar references used in the context of describing a particular embodiment of the application (especially in the context of certain following claims) can be construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application.

Certain embodiments of this application are described herein. Variations on those embodiments will become apparent to those of ordinary skill in the art upon reading the foregoing description. It is contemplated that skilled artisans can employ such variations as appropriate, and the application can be practiced otherwise than specifically described herein. Accordingly, many embodiments of this application include all modifications and equivalents of the subject matter recited in the claims appended hereto as permitted by applicable law. Moreover, any combination of the above-described elements in all possible variations thereof is encompassed by the application unless otherwise indicated herein or otherwise clearly contradicted by context.

Particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

All patents, patent applications, publications of patent applications, and other material, such as articles, books, specifications, publications, documents, things, and/or the like, referenced herein are hereby incorporated herein by this reference in their entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that can be employed can be within the scope of the application. Thus, by way of example, but not of limitation, alternative configurations of the embodiments of the application can be utilized in accordance with the teachings herein. Accordingly, embodiments of the present application are not limited to that precisely as shown and described.

The invention claimed is:

1. A chair comprising:

a seat;

a floor support connected to the seat;

a back base connected to the seat;

at least two side pockets on the back base, respective portions of the back base forming respective back walls of the respective ones of the side pockets, wherein each side pocket has two side walls forming a base and side of the pocket, respectively, and a front wall spaced outwardly from the respective back wall to form a slot that opens upwardly from a top side and laterally outward from a lateral side of the pocket;

at least one top pocket on the back base, a respective portion of the back base forming a back wall of the at least one top pocket, wherein the at least one top pocket has two side walls forming a base and a side of the top pocket, respectively, and a front wall spaced outwardly from the back wall of the top pocket to form a slot that opens upwardly from a top side and laterally inward from a lateral side of the pocket;

a ring; and at least two side flanges connected to the ring that are sized to fit inside of the at least two side pockets, wherein each of the at least two side flanges are sized and oriented with respect to each of the at least two side pockets so that the at least two side flanges are configured to be inserted into the slots of the at least two side pockets.

2. The chair of claim 1, wherein and the ring is connected to at least one top flange and wherein the top flange and top pocket are sized and oriented so that the at least one top flange is configured to be inserted inside the at least top pocket simultaneously while the at least two side flanges are inserted inside the at least two side pockets.

3. The chair of claim 1, wherein each of the at least two side pockets are positioned on opposite sides of the back base.

4. The chair of claim 3, wherein each of the at least two side pockets are oriented so that each of the openings of the at least two side pockets are accessible from a side that is opposite a vertical center line of the chair back.

5. The chair of claim 1, wherein the floor support comprises legs.

6. The chair of claim 1, wherein the ring comprises upholstery covering an opening formed by the ring.

7. The chair of claim 1, wherein the ring comprises a flexible membrane covering an opening formed by the ring.

8. The chair of claim 1, wherein the front wall of the at least two side pockets are approximately parallel to a plane generally defined by the back base.

9. The chair of claim 1, wherein the front wall of the at least two side pockets are angled with respect to a plane generally defined by the back base.

* * * * *